US008290199B2

(12) United States Patent
Pircaro

(10) Patent No.: US 8,290,199 B2
(45) Date of Patent: Oct. 16, 2012

(54) LOUDSPEAKER SUSPENSION

(75) Inventor: Mark A. Pircaro, Yuma, AZ (US)

(73) Assignee: Bose Corporation, Framingham, MA (US)

( * ) Notice: Subject to any disclaimer, the term of this patent is extended or adjusted under 35 U.S.C. 154(b) by 509 days.

(21) Appl. No.: 12/469,777

(22) Filed: May 21, 2009

(65) Prior Publication Data

US 2010/0296689 A1 Nov. 25, 2010

(51) Int. Cl.
*H04R 1/00* (2006.01)

(52) U.S. Cl. ..... 381/398; 381/404; 381/400

(58) Field of Classification Search ..... 381/398–433
See application file for complete search history.

(56) References Cited

U.S. PATENT DOCUMENTS

| | | | | |
|---|---|---|---|---|
| 4,239,943 | A * | 12/1980 | Czerwinski | 381/404 |
| 5,081,684 | A | 1/1992 | House | |
| 5,848,174 | A * | 12/1998 | Ki et al. | 381/404 |
| 5,883,967 | A | 3/1999 | House | |
| 6,222,931 | B1 | 4/2001 | Cesati | |
| 6,501,844 | B2 * | 12/2002 | Proni | 381/403 |
| 6,526,151 | B1 | 2/2003 | Peng | |
| 6,819,773 | B2 | 11/2004 | D'Hoogh | |
| 6,865,282 | B2 | 3/2005 | Weisman | |
| 7,088,842 | B2 * | 8/2006 | Hikichi | 381/430 |
| 7,209,570 | B2 | 4/2007 | Funahashi et al. | |
| 7,292,707 | B2 | 11/2007 | Kreitmeier et al. | |
| 7,426,283 | B2 * | 9/2008 | Kaiya et al. | 381/397 |
| 7,684,586 | B2 * | 3/2010 | Shimamura | 381/401 |
| 7,835,538 | B2 * | 11/2010 | Inoue et al. | 381/423 |
| 2003/0121718 | A1 | 7/2003 | Stead et al. | |
| 2003/0190051 | A1 | 10/2003 | Williamson | |
| 2004/0131221 | A1 * | 7/2004 | Takayama et al. | 381/398 |
| 2005/0271240 | A1 * | 12/2005 | Sato et al. | 381/404 |
| 2005/0271241 | A1 * | 12/2005 | Watanabe | 381/407 |
| 2006/0072248 | A1 | 4/2006 | Watanabe et al. | |
| 2006/0215871 | A1 | 9/2006 | Funahashi et al. | |
| 2007/0177757 | A1 * | 8/2007 | Funahashi et al. | 381/398 |
| 2007/0201718 | A1 * | 8/2007 | Shimoe et al. | 381/396 |
| 2008/0080736 | A1 * | 4/2008 | Sumitani et al. | 381/407 |
| 2009/0232344 | A1 * | 9/2009 | Funahashi | 381/412 |

FOREIGN PATENT DOCUMENTS

| | | | |
|---|---|---|---|
| DE | 3123098 | A1 | 1/1983 |
| JP | 59077797 | | 5/1984 |
| JP | 4003700 | | 1/1992 |
| JP | 11150791 | | 6/1999 |
| JP | 2002345086 | A | 11/2002 |

OTHER PUBLICATIONS

International Search Report and Written Opinion dated Oct. 20, 2010 for Int. Appln. No. PCT/US10/034363.

* cited by examiner

*Primary Examiner* — Savitr Mulpuri

(57) ABSTRACT

A loudspeaker comprising a frame, a voice coil assembly disposed within the frame, a magnet assembly disposed within the frame and a first suspension element having an outer edge and an inner edge, wherein the outer edge is coupled to the voice coil assembly and the inner edge is coupled to the magnet assembly.

5 Claims, 16 Drawing Sheets

LOUDSPEAKER SUSPENSION

BACKGROUND

This specification relates generally to the field of loudspeakers. More particularly, this specification relates to a suspension system for the voice coil assembly of a loudspeaker.

In general, a loudspeaker includes a frame, a moving assembly, and a suspension system, which mechanically couples the moving assembly to the frame in a manner that permits the moving assembly to move relative to the frame. The moving assembly includes a diaphragm, which vibrates to radiate pressure waves that are perceived as sound. The suspension system, which may include one or more suspension elements, preferably permits movement along a single axis, so that contact between the moving assembly and the frame, or elements rigidly coupled to the frame, are avoided.

One common type of loudspeaker is a moving coil loudspeaker. In a moving coil loudspeaker, the moving assembly includes a voice coil assembly. The voice coil assembly includes a voice coil former, which is typically a tube with a circular cross section, but which may have some other form of cross section, such as square or rectangular. The moving assembly also includes a voice coil, which is typically formed by tightly winding an electrically conductive wire around the voice coil former. The diaphragm is mechanically coupled to the voice coil assembly. Audio signals, in the form of electrical current in the voice coil, interact with the magnetic field of a magnet assembly which is rigidly coupled to the frame, to cause the diaphragm to vibrate, radiating pressure waves that are perceived as sound.

Another type of loudspeaker is a moving magnet loudspeaker. In a moving magnet loudspeaker, the voice coil assembly is rigidly coupled to the frame, and the moving assembly includes a magnet assembly, mechanically coupled to the diaphragm. Audio signals, in the form of electrical current in the voice coil, interact with the magnetic field of the magnet assembly, to cause the diaphragm to vibrate, radiating pressure waves that are perceived as sound. In this specification, the examples are moving voice coil loudspeakers, but the principles described herein may be applied to moving magnet loudspeakers provided the suspension system has adequate properties such as lateral stiffness.

A first common type of moving voice coil loudspeaker includes a voice coil assembly in which the diameters of the voice coil former and the diaphragm are substantially the same. In these loudspeakers, the outer-most edge of the diaphragm is attached to the upper periphery of the voice coil former. The moving assembly is typically secured to the frame of the loudspeaker by at least a first support element, commonly referred to as a "surround", which has an inner edge secured to the moving assembly and an outer edge that is secured to the frame. Alternate embodiments may include a second support element, commonly called a "spider", which includes an inner edge secured to a bottom portion of the voice coil former and an outer edge that is secured to the frame of the loudspeaker. This type of construction is typically found in smaller loudspeakers, such as tweeters, and possibly mid-range speakers.

A typical issue encountered with smaller-sized loudspeakers is that as the loudspeaker becomes smaller, achieving low frequency response becomes more difficult. Low frequency response requires a loudspeaker to displace a larger volume of air to achieve the lower frequencies, as compared to achieving higher frequencies. The volume of air that a loudspeaker can displace is dependent upon the area of the diaphragm and the peak-to-peak excursion of the voice coil assembly that is allowed by the suspension. As the axial stiffness of the suspension is reduced to allow a greater excursion of the voice coil assembly, the radial stiffness of the suspension is usually similarly decreased. To operate at maximum efficiency, the suspension system in smaller loudspeakers should allow a maximum amplitude of axial displacement while constraining the voice coil assembly from moving side to side in order to avoid contact between the voice coil assembly and the other portions of the loudspeaker. As would be expected, as the stiffness of the suspension is reduced, greater side to side motion of the voice coil assembly is usually allowed. This is especially true in those loudspeaker embodiments that only include a single support element securing the voice coil assembly to the frame of the loudspeaker.

In a second type of moving coil loudspeaker, the moving assembly includes a diaphragm that is formed by a cone (or some other planar or non-planar surface, such as a concave surface) having a diameter that is greater than the diameter of the voice coil former. In this type of loudspeaker, an inner periphery of the cone is typically secured to an upper portion of the voice coil former and a first support member has an inner edge secured to an outer periphery of the diaphragm and an outer edge that is secured to the frame of the loudspeaker. A second support member has an inner edge that is secured to a lower portion of the voice coil former and an outer edge that is secured to the frame of the loudspeaker. In this type of loudspeaker, it is often desirable to reduce the outer-most dimensions of the frame of the loudspeaker to facilitate mounting the loudspeaker in various environments where space may be limited.

SUMMARY

In one aspect, a loudspeaker includes a frame; a moving assembly disposed within the frame; and a first suspension element having an outer edge and an inner edge, wherein the outer edge is coupled to the moving assembly and the inner edge is coupled to the frame. The moving assembly may include a voice coil assembly. The first suspension element may be coupled to the frame by a magnet assembly, rigidly coupled to the frame. The voice coil assembly may be disposed around the magnet assembly. The magnet assembly may further include a magnet secured to the frame and a coin secured to a top portion of the magnet. The inner edge of the first suspension element may be coupled to the coin of the magnet assembly. The inner edge of the first suspension element may be coupled to the magnet of the magnet assembly. The voice coil assembly may further include a voice coil former having a top edge and a bottom, and a voice coil disposed around an outer surface of the voice coil former. The outer edge of the first suspension element may be coupled to the voice coil former. The outer edge of the first suspension element may be coupled to the voice coil former adjacent a bottom edge of the voice coil former. The loudspeaker may further include a second suspension element having an outer edge and an inner edge. The outer edge may be coupled to the frame and the inner edge may be coupled to the moving assembly. The loudspeaker may further include a cone having an outer periphery and an inner periphery. The outer periphery may be coupled to the frame and the inner periphery may be coupled to the voice coil assembly. The inner periphery of the cone may be coupled to the voice coil former. The first suspension element may include an inner circumferential border and an outer circumferential border, and grooves extending from the inner circumferential border to the outer circumferential border at an angle with respect to a normal to the inner circumferential border. The first suspension element may extend inwardly from the outer edge to the inner edge of the first suspension element.

In another aspect, a loudspeaker includes a frame; a moving assembly; and a first suspension element coupling the moving assembly and the frame, the first suspension element extending radially inwardly from the moving assembly. The loudspeaker may further include a magnet assembly including a magnet and a coin disposed within the frame. The moving assembly may be coupled to the frame by the magnet assembly. An inner edge of the first suspension element member may be coupled to the coin. An inner edge of the first suspension element may be coupled to the magnet.

Figure 1:
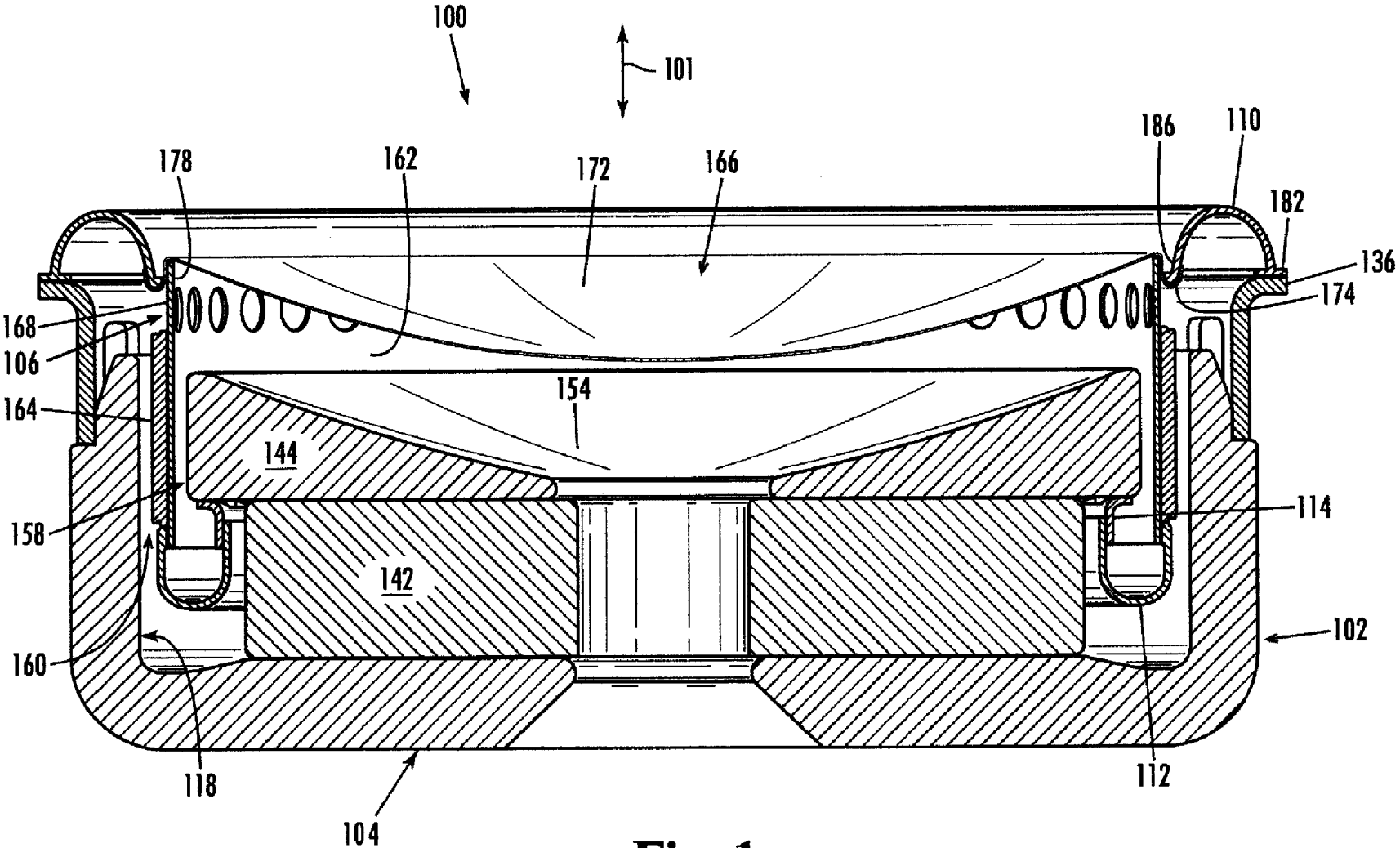
FIG. 1 is a cross-sectional view of a loudspeaker.

Repeat use of reference characters in the present specification and drawings is intended to represent same or analogous features or elements.

DETAILED DESCRIPTION

Reference will now be made in detail to the accompanying drawings. Each example is provided by way of explanation, not limitation. In fact, it will be apparent to those skilled in the art that modifications and variations can be made without departing from the scope and spirit of the claims. For instance, features illustrated or described as part of one embodiment may be used on another embodiment to yield a still further embodiment. Thus, it is intended that such modifications and variations come within the scope of the appended claims and their equivalents.

Referring now to FIG. 1, a loudspeaker 100 includes a motor assembly. The motor assembly includes a magnet assembly 104 and a voice coil assembly 106. Magnet assembly 104 includes a magnet 142, a top plate, typically referred to as a "coin", 144 in contact with a top surface of the magnet, and a cup 102, in contact with a bottom surface of the magnet 142. The cylindrical outer surface 158 of coin 144 and the cylindrical inner surface 118 of cup 102 are concentric such that a uniform air gap 160 is formed between coin 144 of magnet assembly 104 and cup 102. Voice coil assembly 106 includes a cylindrical voice coil former 162, a voice coil 164 and a diaphragm 166. Voice coil 164 is formed about an outer surface 168 of voice coil former 162 by a series of windings of conductive wire. The voice coil assembly 106 is mechanically coupled to a diaphragm 166 that includes a diaphragm body 172 and a u-shaped lip 174. The diaphragm 166 is mechanically coupled to a surround 110, which is in turn mechanically coupled to a mounting plate 108 of FIG. 3A-3C. The mechanical coupling of the diaphragm includes an inner lip 186 that mates with, and is attached to (for example by an adhesive or by co-molding) u-shaped lip 174. The mechanical coupling of the surround to the mounting plate 108 includes a surround foot 182 which is attached to flange 136. In this and in subsequent figures, the surround foot 182 has an inverted "T", but for ease of manufacture, it may have an "L" shape. The voice coil assembly 106 is also mechanically coupled to the outer edge of a spider 112. The inner edge of the spider 112 is mechanically coupled to the magnet assembly 104. The voice coil is mechanically coupled to the outer edge of the spider 112. The mechanical coupling of the inner edge of spider 112 to the magnet assembly 104 may include a mounting ring 114, attached to the spider 112 and the magnet assembly. The surround 110 and the spider 112 position the voice coil assembly 106 which is mounted within cup 102, such that voice coil 164 is concentrically received within air gap 160 defined by outer surface 158 of coin 144 and inner surface 118 of cup 102.

Figure 3A:
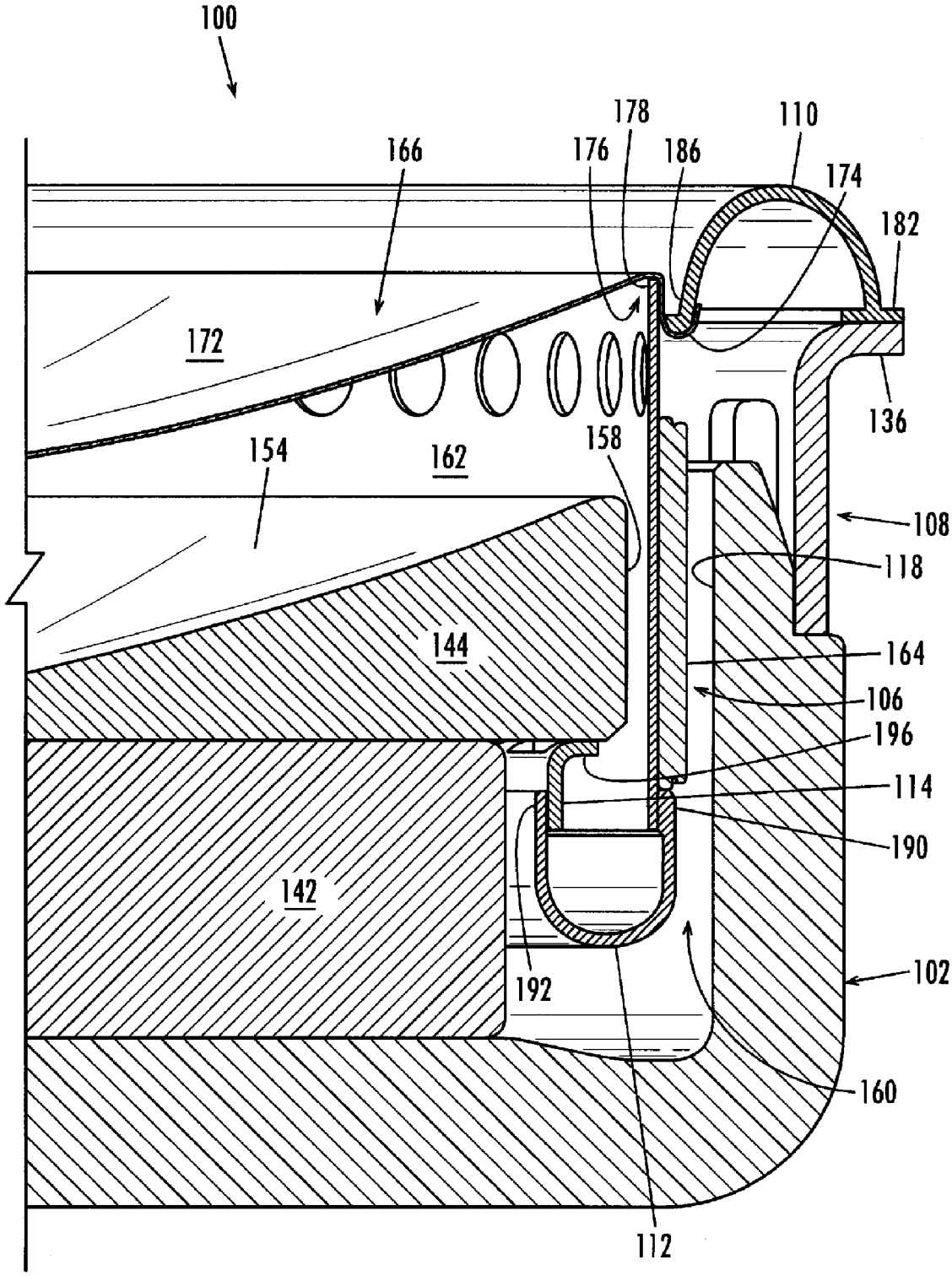
FIGS. 3A, 3B and 3C are partial cross-sectional views of the loudspeaker as shown in FIG. 1, that show the peak-to-peak excursion range of the voice coil assembly of the loudspeaker.

Diaphragm 166 includes a body 172, a U-shaped lip 174 disposed about the outer periphery of body 172, and a groove 176 (FIG. 3A) formed therebetween. Body 172 is an outwardly facing concave surface that is correspondingly similarly shaped to top surface 154 of coin 144. As such, downward deflection of voice coil assembly 106 relative to magnet assembly 104 may be achieved while minimizing the possibility that diaphragm 166 will make contact with coin 144. As best seen in FIG. 3A, diaphragm 166 is positioned on voice coil former 162 by placing top edge 178 of voice coil former 162 in groove 176 that is disposed between body 172 and U-shaped lip 174. Diaphragm 166 is mechanically coupled to top edge 178 of voice coil former 162. U-shaped lip 174 extends outwardly from top edge 178 of voice coil former 162 and facilitates the attachment of voice coil assembly 106 to mounting plate 108.

In operation, audio signals applied to the voice coil 164 interact with the magnetic field of the magnet assembly 104 to cause oscillatory motion of the voice coil assembly 106, which in turn causes oscillatory motion of the diaphragm 166 in the motion indicated by arrow 101. The oscillatory motion of the diaphragm causes the radiation of pressure waves, which are perceived as sound.

Figure 2:
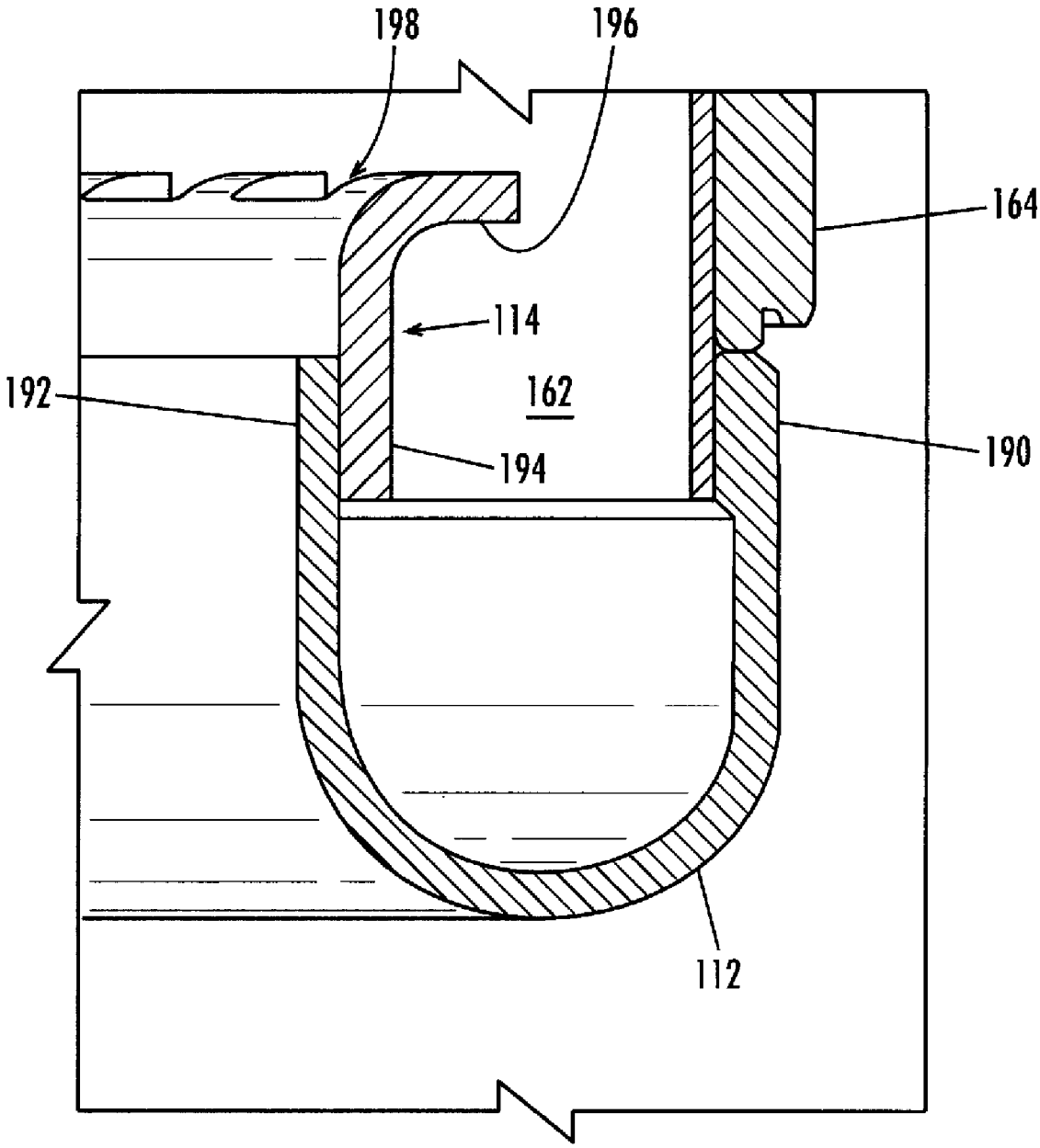
FIG. 2 is an enlarged, partial cross-sectional view of the loudspeaker as shown in FIG. 1.

As shown in FIG. 2, voice coil former 162 is secured to the bottom surface of the coin by spider element 112 and mounting ring 114. Spider element 112 includes a foot 190 disposed along its outer edge and an inner lip 192 that is connected to foot 190 by a spider body that is constructed of flexible material. The spider body may be half-round, as shown, or may have some other configuration, such as corrugated or having multiple rolls, or some more complex geometry, such as is described in U.S. Pat. No. 7,397,927, incorporated herein by reference in its entirety. Similar to surround element 110 of FIG. 1, spider element 112 is preferably formed of a high temperature, injection moldable elastomer, such as silicone. Foot 190 of spider element 112 is secured to the bottom edge of voice coil former 162 and inner lip 192 is secured (for example by an adhesive or by co-molding) to a side wall 194 of mounting ring 114. Mounting ring 114 includes an outwardly extending lip which may be formed by plurality of fingers 196 that are separated by gaps 198. In some implementations, gaps 198 may extend to near the top of the joint between the inner lip 192 and the side wall 194 to permit airflow through the gaps 198 to equalize pressure between the two sides of the spider element 112; alternatively, some other method of equalizing pressure relief may be provided. Fingers 196 of mounting ring 114 are secured to the bottom surface of the coin, thereby securing the bottom portion of voice coil assembly 106 to magnet assembly 104. In other embodiments, a solid ring structure may be substituted for the fingers 196 and gaps 198.

Figure 3B:
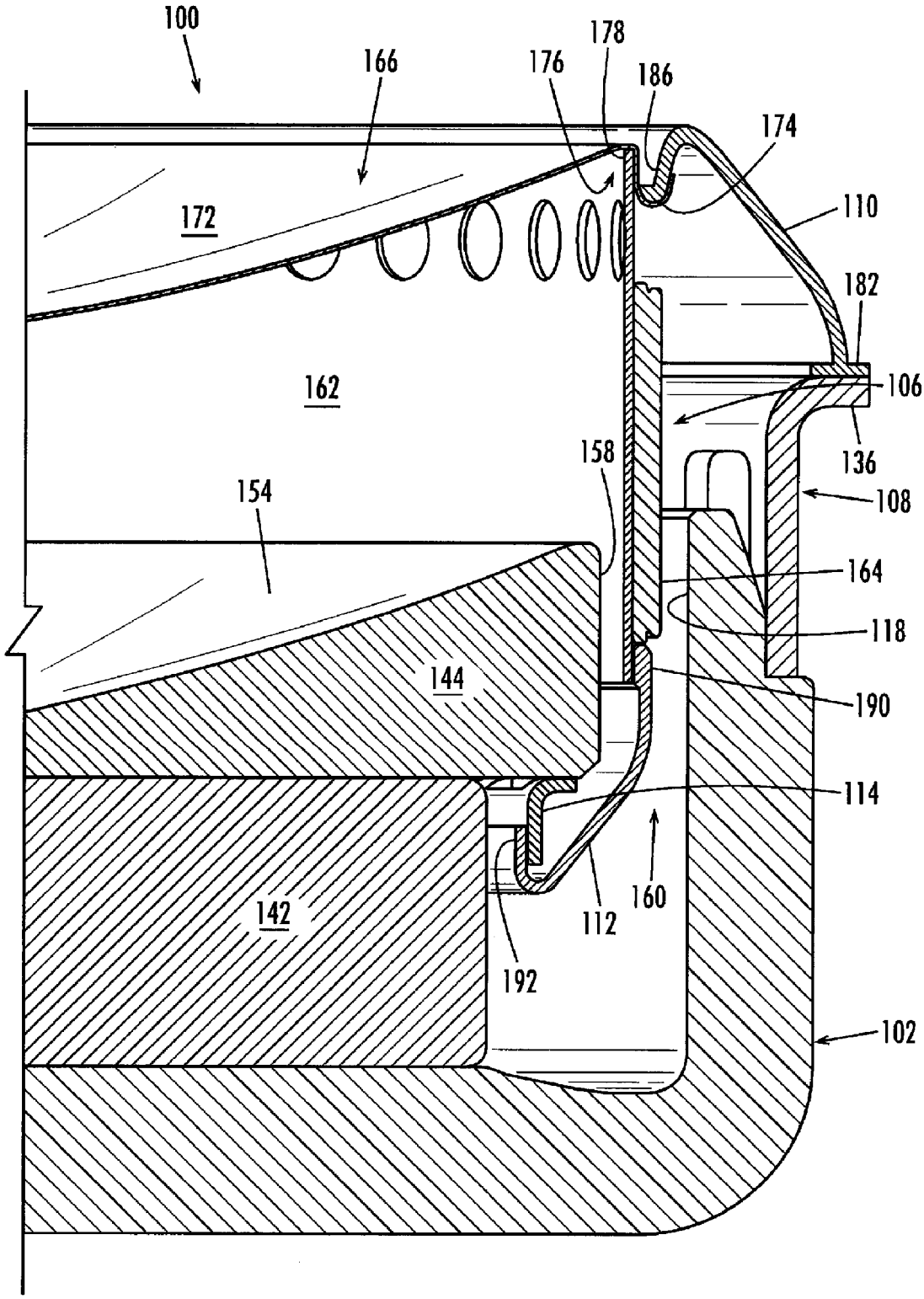
Figure 3C:
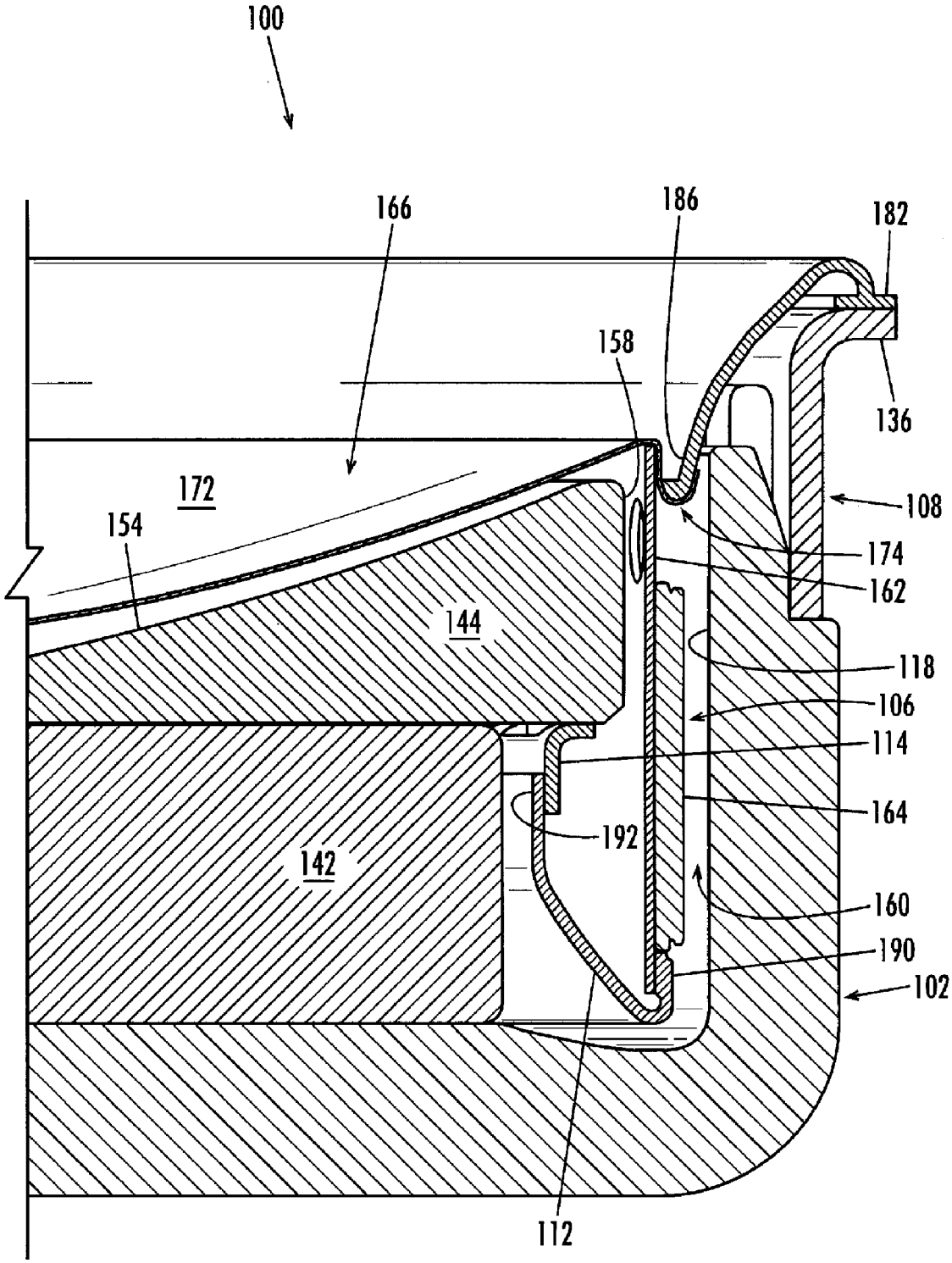

FIGS. 3A through 3C show the range of motion for voice coil assembly 106 of the embodiment of the loudspeaker shown in FIGS. 1 through 6 during a peak-to-peak excursion of voice coil assembly 106, as would occur during use of the loudspeaker. As best seen in FIG. 3A, voice coil 164 is preferably approximately centered about the mid-point of coin 144 of the magnet assembly when voice coil assembly 106 is in the at-rest position.

In one embodiment, loudspeaker 100 has a nominal height (h) of 18.2 millimeters whereas the nominal outer diameter of the cup 102, or width (w), is 40.0 millimeters, giving loudspeaker 100 a nominal cylindrical volume of about 22.9 cubic centimeters. Surround element 110 and spider element 112 of loudspeaker 100 have a thickness and shape so that consistent with a Young's modulus of $2\times10^7$ Pa, the desired force/deflection behavior of the aggregate suspension is attained. A loudspeaker 100 in accordance with FIG. 1 provides increased rocking stiffness over conventional loudspeakers over the entire range of axial deflection, and also allows loudspeaker 100 to attain substantially the same peak-to-peak axial excursion range as conventional loudspeakers.

Referring now to FIGS. 4 through 9, alternate embodiments of loudspeakers are shown. The alternate embodiments shown in FIGS. 4 through 9 are substantially similar to loudspeaker 100, as shown in FIG. 1. As such, portions of the loudspeakers that are consistent between the various embodiments are represented by the same reference numbers in the Figures. Additionally, because like components are described in detail above with regard to loudspeaker 100, those descriptions are not repeated with regard to the alternate embodiments as shown in FIGS. 4 through 9. Only those elements of the alternate embodiments that differ substantially from loudspeaker 100 are discussed.

Figure 4:
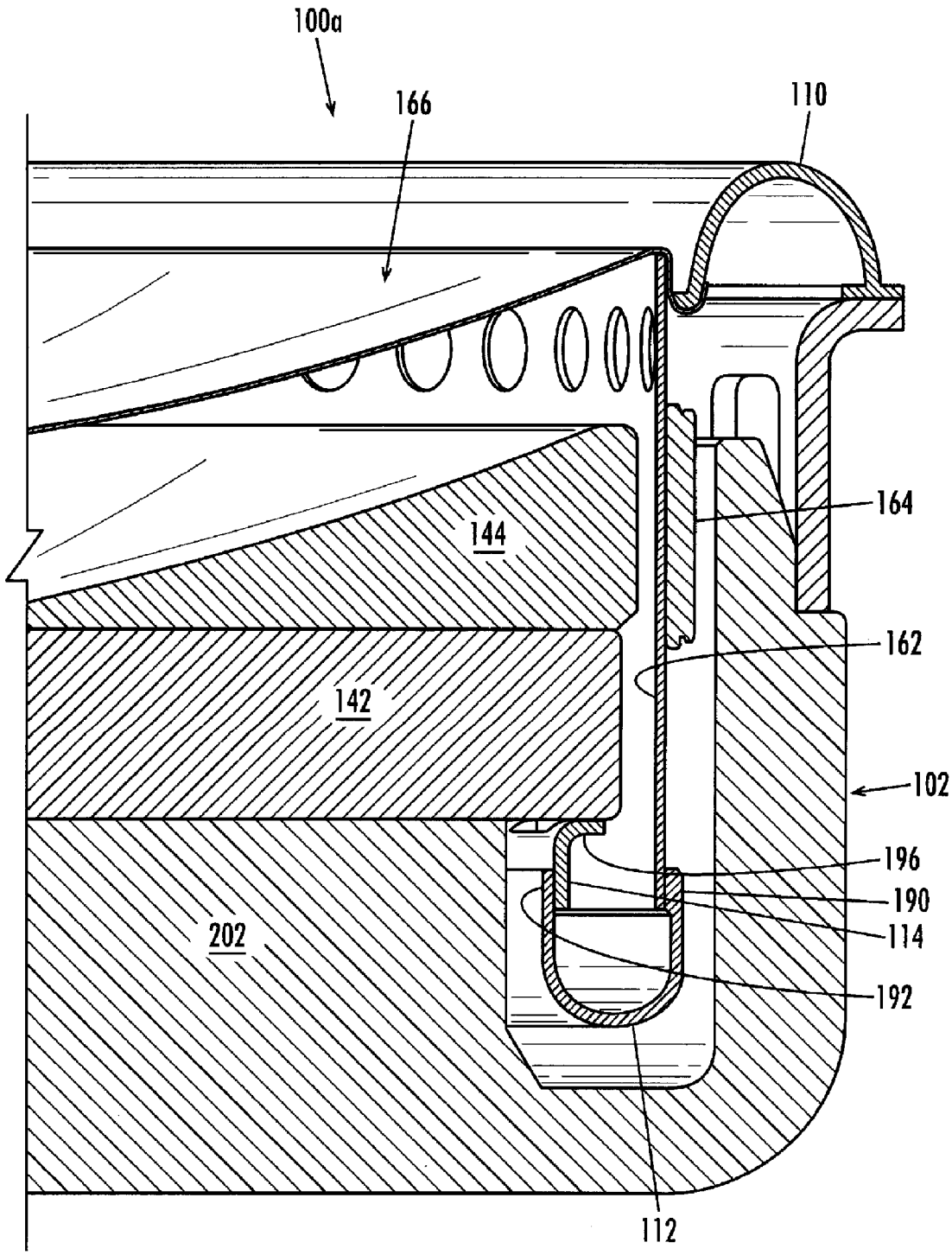
FIG. 4 is a partial cross-sectional view of an alternate embodiment of a loudspeaker.

Referring now to FIG. 4, loudspeaker 100*a* includes a magnet assembly 104 (of FIG. 1) with a throttle 202 in addition to magnet 142 and coin 144. As shown, throttle 202 extends upwardly from the bottom surface of cup 102 and supports magnet 142 on its top surface. As shown, throttle 202 is unitarily formed with cup 102.

Figure 5:
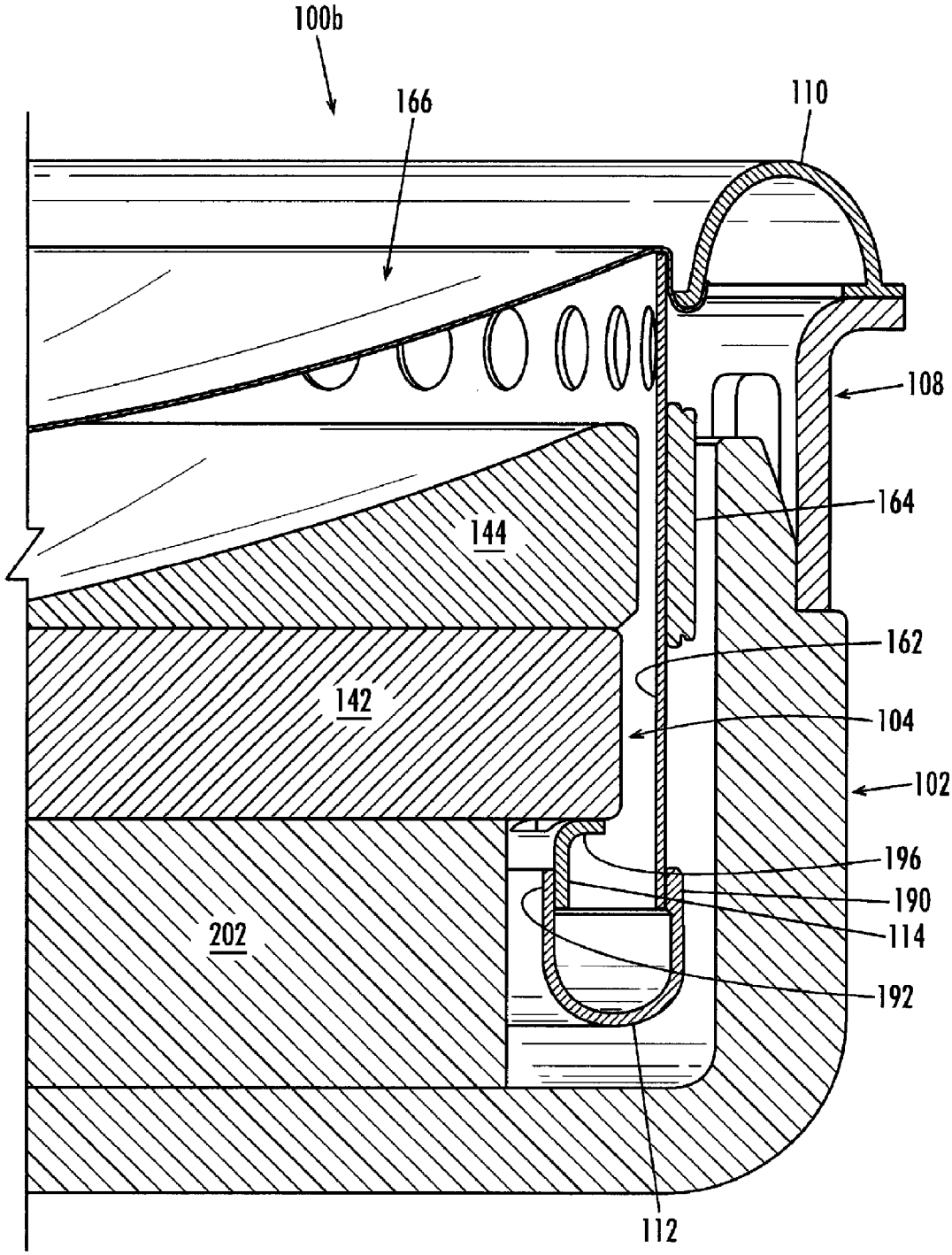
FIG. 5 is a partial cross-sectional view of an alternate embodiment of a loudspeaker.

Referring now to FIG. 5, loudspeaker 100*b* also includes a magnet assembly 104 that includes a throttle 202 in addition to magnet 142 and coin 144. Loudspeaker 100*b* differs from loudspeaker 100*a*, as shown in FIG. 4, in that throttle 202 is not unitarily formed with cup 102. Rather, throttle 202 is formed as a separate component and then secured to the base of cup 102.

Figure 6:
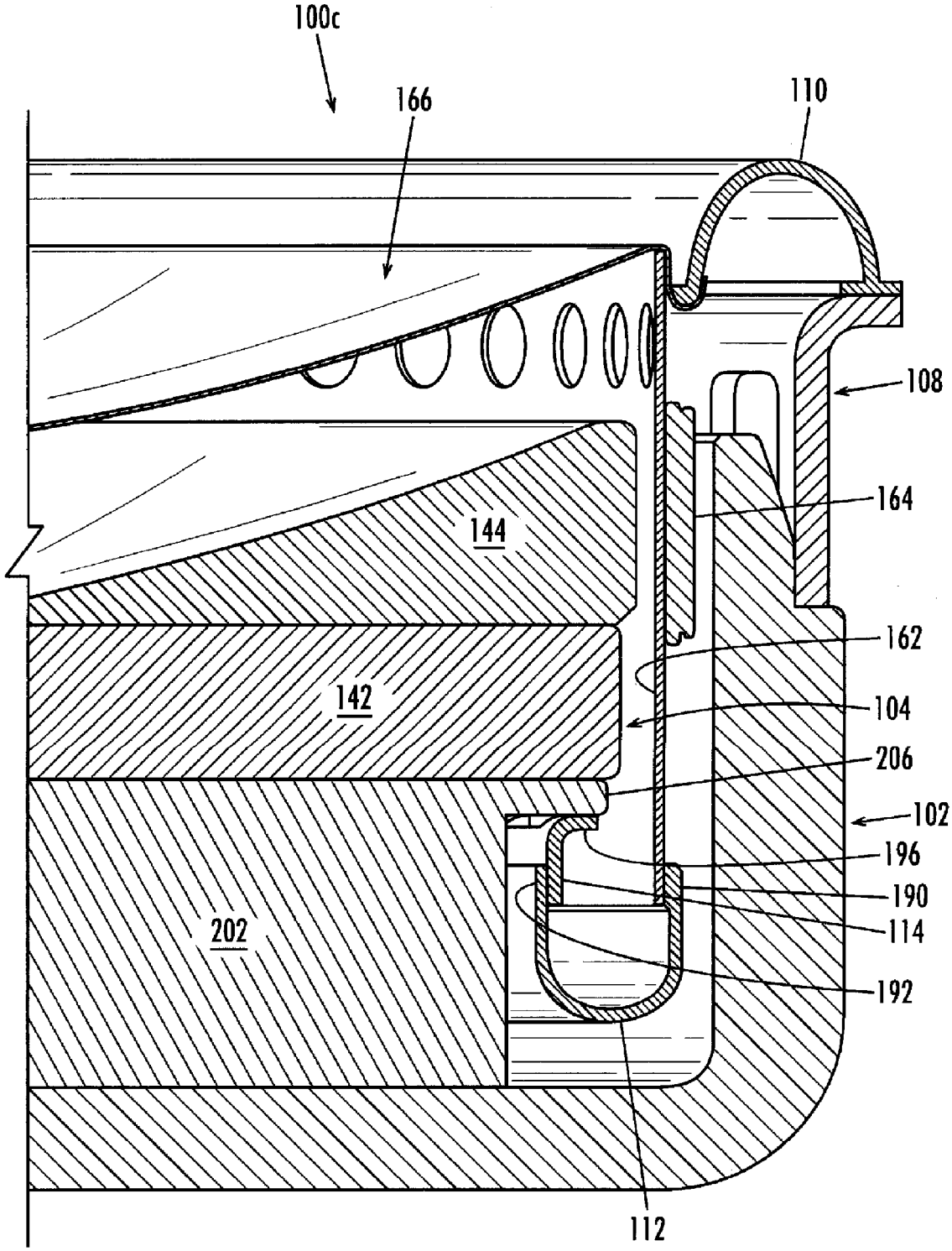
FIG. 6 is a partial cross-sectional view of an alternate embodiment of a loudspeaker.

Referring now to FIG. 6, loudspeaker 100*c* includes a magnet assembly 104 that includes a throttle 202 in addition to magnet 142 and coin 144. Similarly to loudspeaker 100*b* shown in FIG. 5, throttle 202 is formed separately from cup 102. However, throttle 202 includes a flange 206 that extends radially outwardly from the periphery of its top surface. As shown, flange 206 extends outwardly to approximately the full diameter of magnet 142. Note, in loudspeaker 100*c*, fingers 196 of mounting ring 114 are secured to the bottom surface of flange 206 rather than the bottom surface of magnet 142, as in the previously discussed embodiments.

Figure 7:
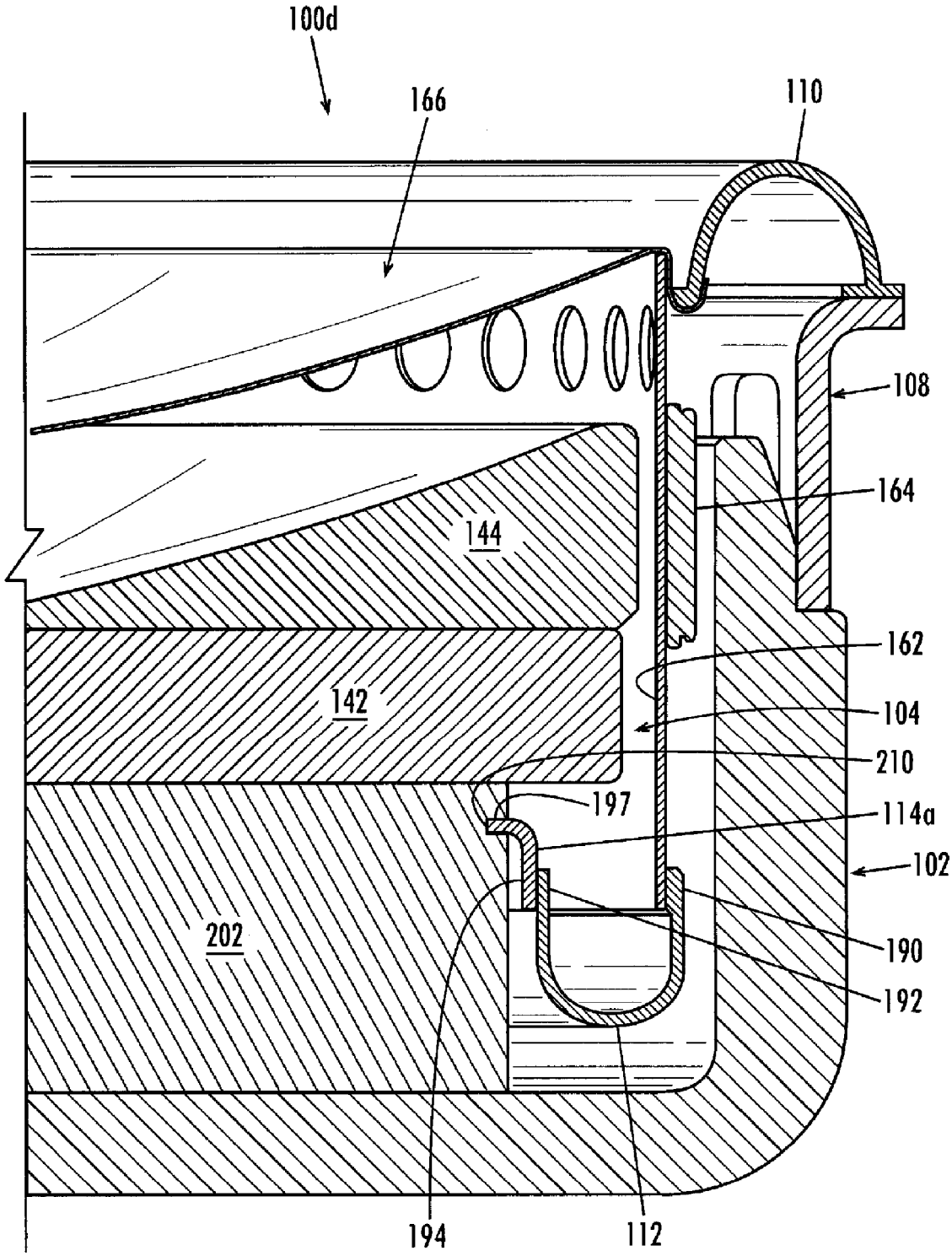
FIG. 7 is a partial cross-sectional view of an alternate embodiment of a loudspeaker.

Referring now to FIG. 7, loudspeaker 100*d* includes a magnet assembly 104 with a throttle 202 in addition to magnet 142 and coin 144. Throttle 202 includes a circumferential groove 210 that extends inwardly from the outer circumferential surface of throttle 202 proximate its top surface. Circumferential groove 210 is configured to receive a plurality of fingers 197 which extend inwardly from a sidewall 194 of mounting ring 114*a*, which is in contrast to the previously discussed embodiments. For the embodiment shown, to enable fingers 197 of mounting ring to be received in groove 210, a material can be selected for mounting ring 114*a* such that fingers 197 are slightly deflectable when being installed. However, if a more rigid material is to be used for the manufacture mounting ring 114*a*, or if the mounting ring does not have fingers 196 and gaps 198, mounting ring 114*a* may be constructed in two or more pieces.

Figure 8:
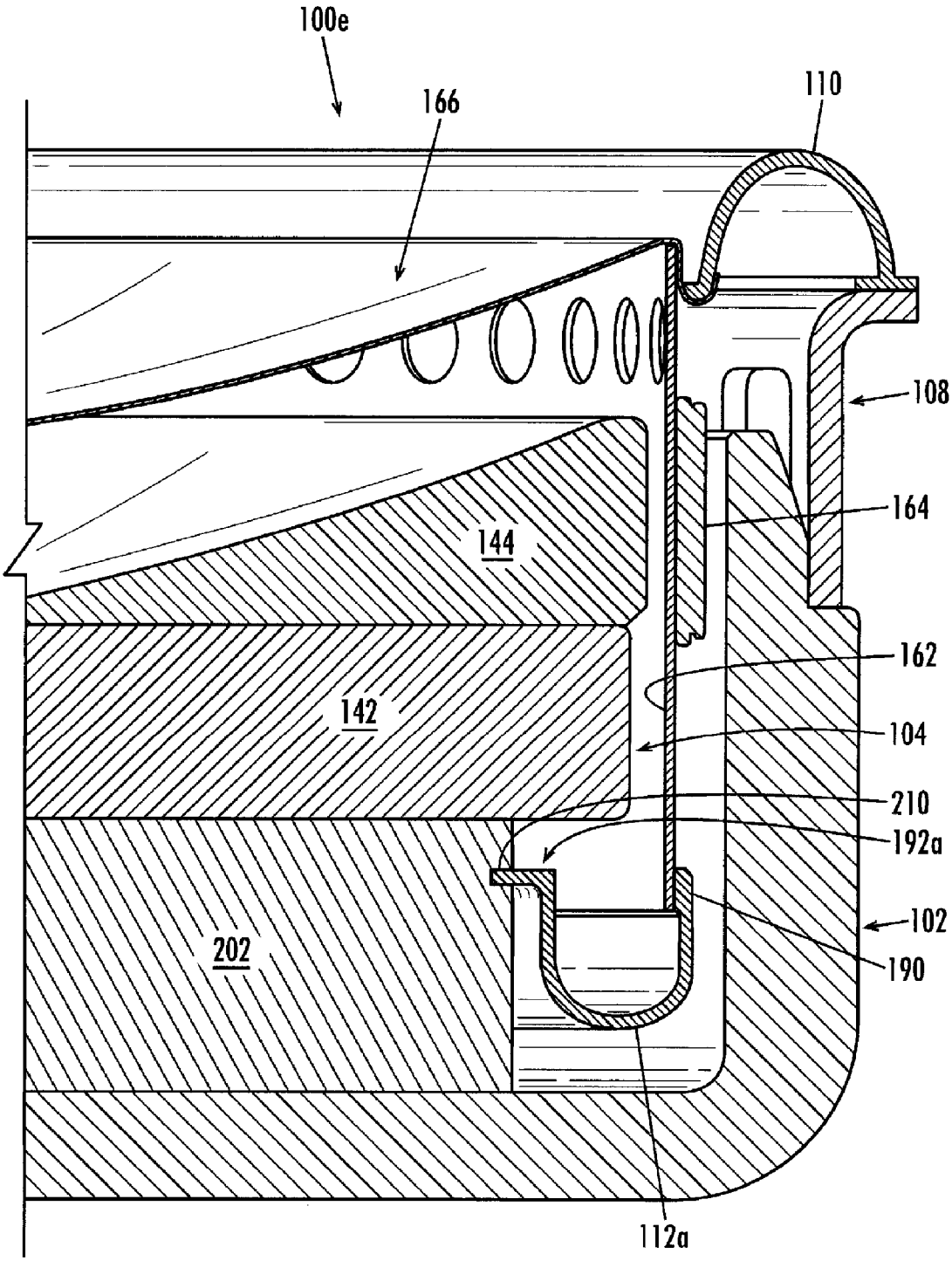
FIG. 8 is a partial cross-sectional view of an alternate embodiment of a loudspeaker.

Referring now to FIG. 8, loudspeaker 100*e* includes a magnet assembly 104 with a throttle 202 in addition to magnet 142 and coin 144. Similar to loudspeaker 100*d* shown in FIG. 7, throttle 202 of loudspeaker 100*e* includes a circumferential groove 210 that extends inwardly from the outer surface of throttle 202 proximate its top surface. Note, however, that loudspeaker 100*e* does not include a mounting ring, as do all the previously embodiments. Rather, a spider element 112*a* includes an inner lip 192 that extends radially inwardly and is configured to engage circumferential groove 210. Because spider 112*a* is preferably constructed from an elastomeric material, inner lip 192 is readily deflectable such that it may be installed in circumferential groove 210.

Figure 9:
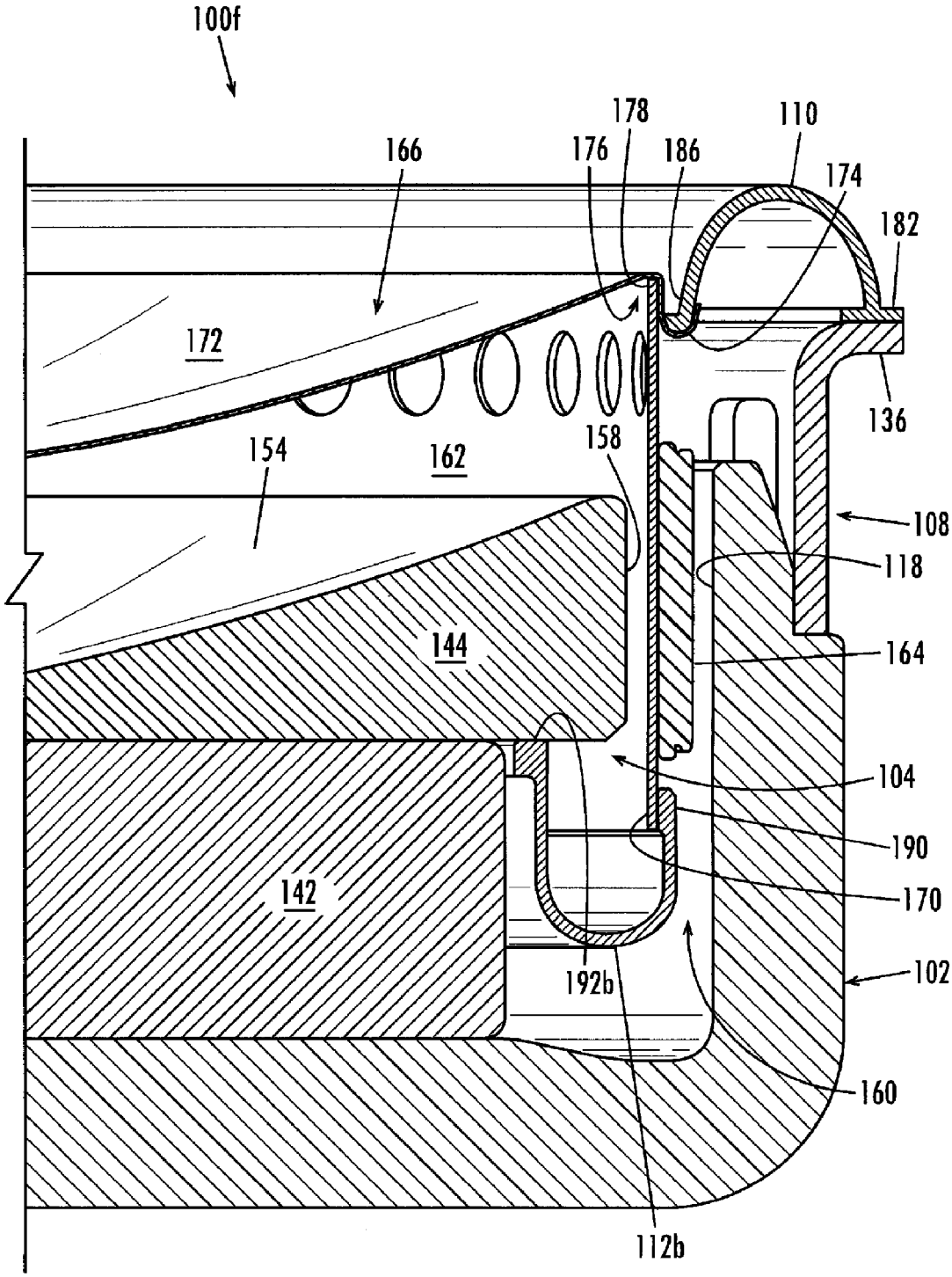
FIG. 9 is a partial cross-sectional view of an alternate embodiment of a loudspeaker.

Referring now to FIG. 9, loudspeaker 100*f* also lacks a mounting ring for securing the spider element to magnet assembly 104. As shown, an inner lip 192*b* of spider 112*b* extends upwardly past magnet 142 and is secured to the bottom surface of coin 144. Preferably, inner lip 192*b* is secured to coin 144 by an adhesive.

Figure 10:
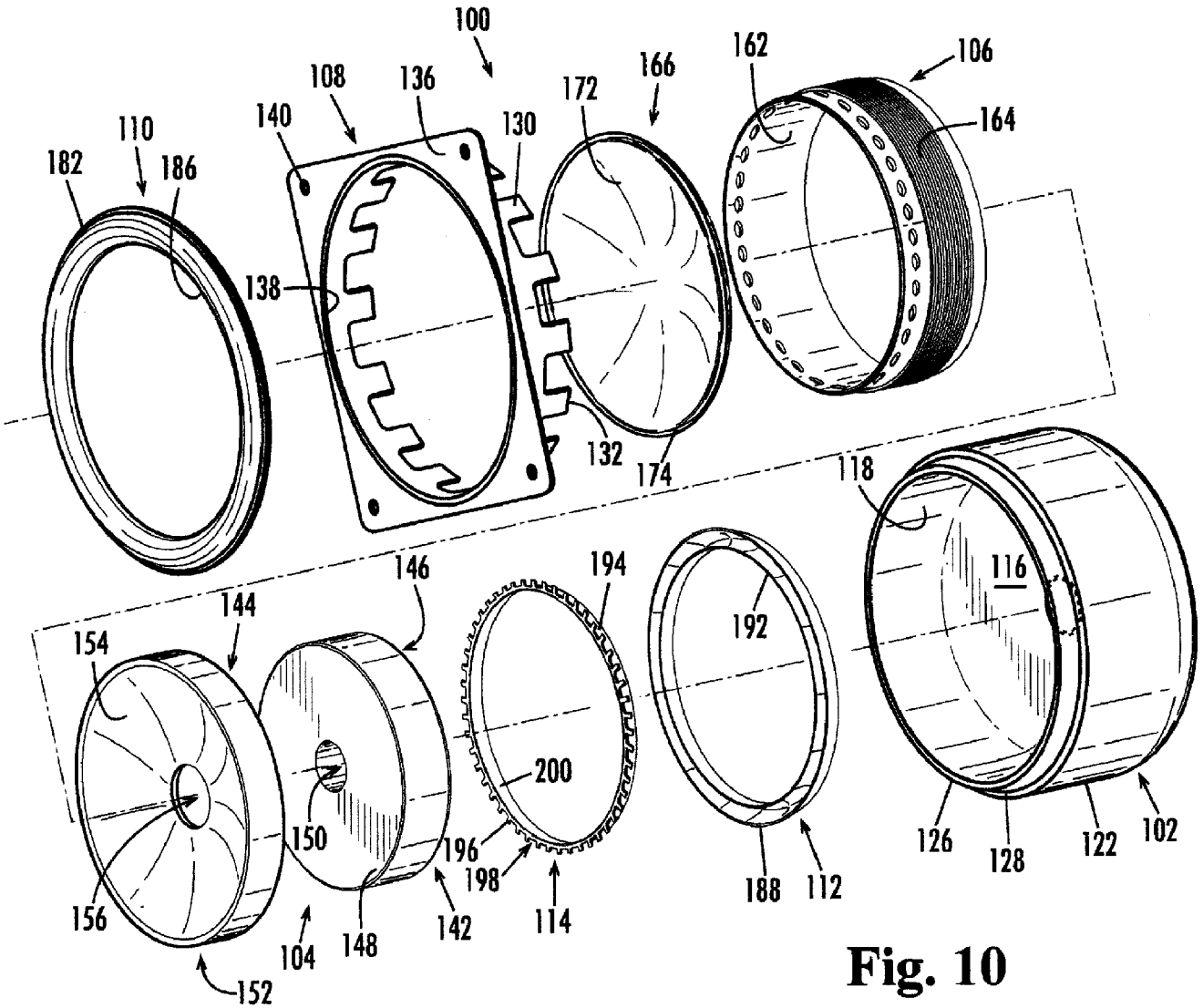
FIG. 10 is an exploded perspective view of the loudspeaker of FIG. 1.

Referring now to FIG. 10, an exploded view of a loudspeaker 100 incorporating the elements of FIG. 1 is shown. Reference numbers in FIG. 10 correspond to like numbers in the previous views.

Figure 11:
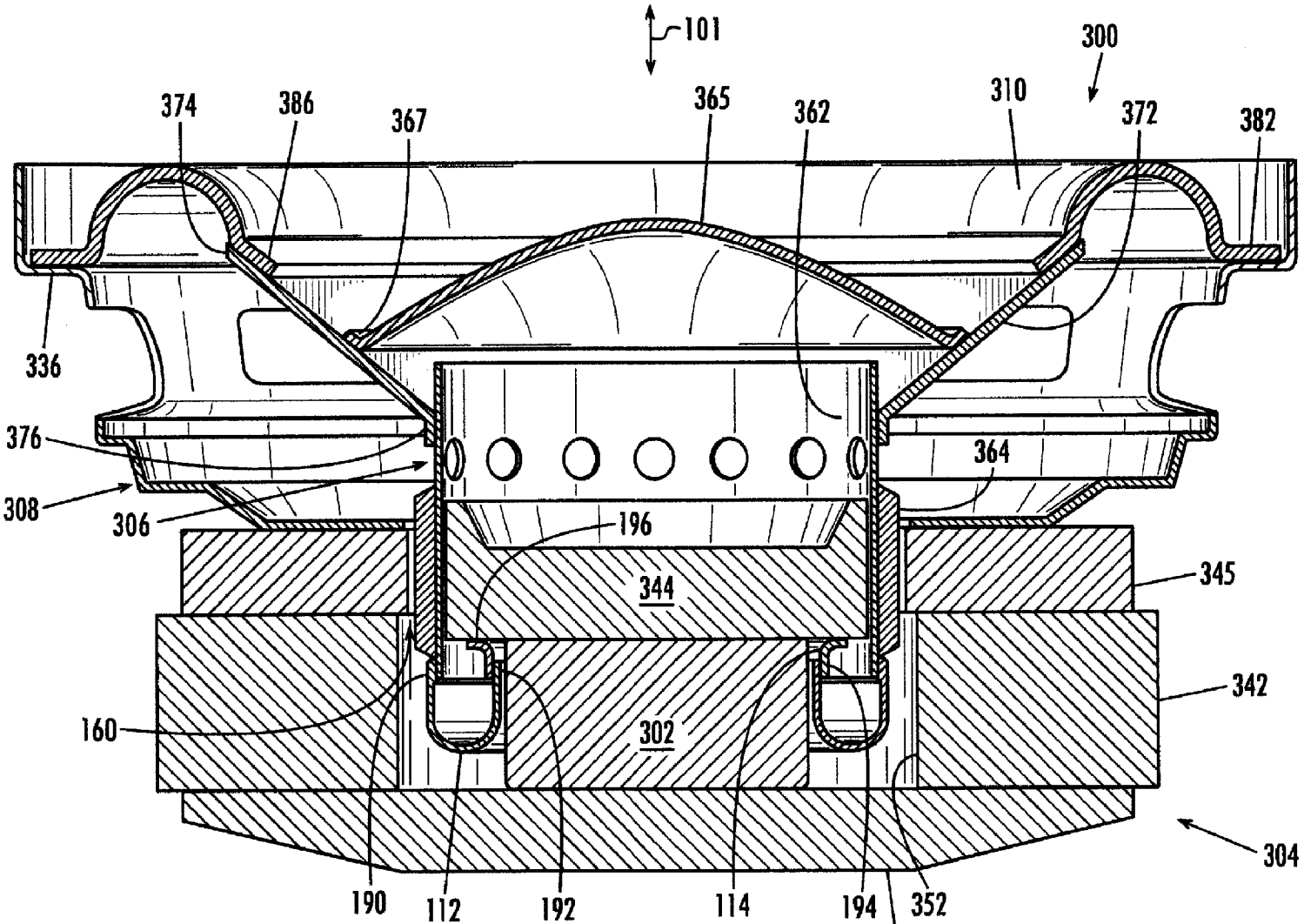
FIG. 11 is a cross-sectional view of a loudspeaker.

FIG. 11 shows a loudspeaker 300. Loudspeaker 300 includes a motor assembly which includes a magnet assembly 304 and a voice coil assembly 306. Magnet assembly 304 includes a throttle 302 and a coin 344 that are disposed within the volume defined by the top surface of bottom plate 316 and the inner surface 352 of magnet 342 and the inner surface of the front plate 345. Throttle 302 is fixed to the top surface of bottom plate 316 and coin 344 is fixed to the top surface of throttle 302. The diameter of coin 344 is greater than that of throttle 302 such that the outer surface of coin 344 extends radially outwardly beyond the outer surface of throttle 302. Additionally, the outer surface of coin 344 is cylindrical and concentric with the inner surface of front plate 345 such that a uniform air gap 160 is formed between coin 344 and front plate 345.

Voice coil assembly 306 includes a typically cylindrical voice coil former 362 and a voice coil 364. Voice coil 364 is usually formed about an outer surface of voice coil former 362 by a series of windings of conductive wire. As best seen in FIG. 11, voice coil assembly 306 is mounted within the portion of the outer structure of the frame defined by various components of magnet assembly 304 such that voice coil 364 is concentrically received within air gap 160 defined by the outer surface of coin 344 and the inner surface of front plate 345.

Loudspeaker 300 includes a cone 372. Cone 372 includes an outwardly facing concave or convex top surface that extends from an outer periphery 374 to an inner periphery 376. Adhesives or co-bonding may be used to secure inner periphery 376 in the desired position on voice coil former 362. Outer periphery 374 is secured to mounting flange 336 of frame 308 by surround element 310. Surround element 310 includes a foot 382 extending along its outer edge and an inner lip 386. Inner lip 386 is secured to the top surface of outer periphery 374 of cone 372 and foot 382 of surround element 310 is secured to mounting flange 336. Preferably, surround element 310 is formed of a high temperature, injection moldable elastomer, such as silicone. A dust cap 365 covers the central aperture defined in cone 372 by inner periphery 376. Preferably, dust cap 365 is fixed to cone 372 by an outer lip 367 that is secured to the top surface of cone 372 with adhesives.

Voice coil former 362 of the present embodiment may be secured to the bottom surface of coin 344 by spider element 112 and mounting ring 114 as shown, or in a manner analogous to FIG. 8, the spider element 112 may connected to throttle 302. In this embodiment, spider element 112 includes a foot 190 disposed along its outer edge and an inner lip 192 that is connected to foot 190 by a spider body that is constructed of flexible material. The spider body may be half-round, as shown, or may have some other configuration, such as corrugated or having multiple rolls, or some more complex geometry, such as is described in U.S. Pat. No. 7,397,927, incorporated herein by reference in its entirety. Similar to surround element 310, spider element 112 is preferably formed of a high temperature, injection moldable elastomer, such as silicone. Foot 190 of spider element 112 is secured to the bottom edge of voice coil former 362 and inner lip 192 is secured to the sidewall 194 of mounting ring 114. Mounting ring 114 includes an outwardly extending lip, which may be formed by a plurality of fingers 196 that are separated by gaps 198 (see FIG. 2). Fingers 196 of mounting ring 114 are secured to the bottom surface of coin 344, thereby securing the bottom portion of voice coil assembly 306 to magnet assembly 304. In other embodiments, a solid ring structure may be substituted for the fingers 196 and gaps 198.

In operation, audio signals applied to the voice coil 364 interact with the magnetic field of the magnet assembly 304 to cause oscillatory motion of the voice coil assembly 306, which in turn causes oscillatory motion of the cone 372 in the motion indicated by arrow 101. The oscillatory motion of the diaphragm causes the radiation of pressure waves, which are perceived as sound.

Figure 12:
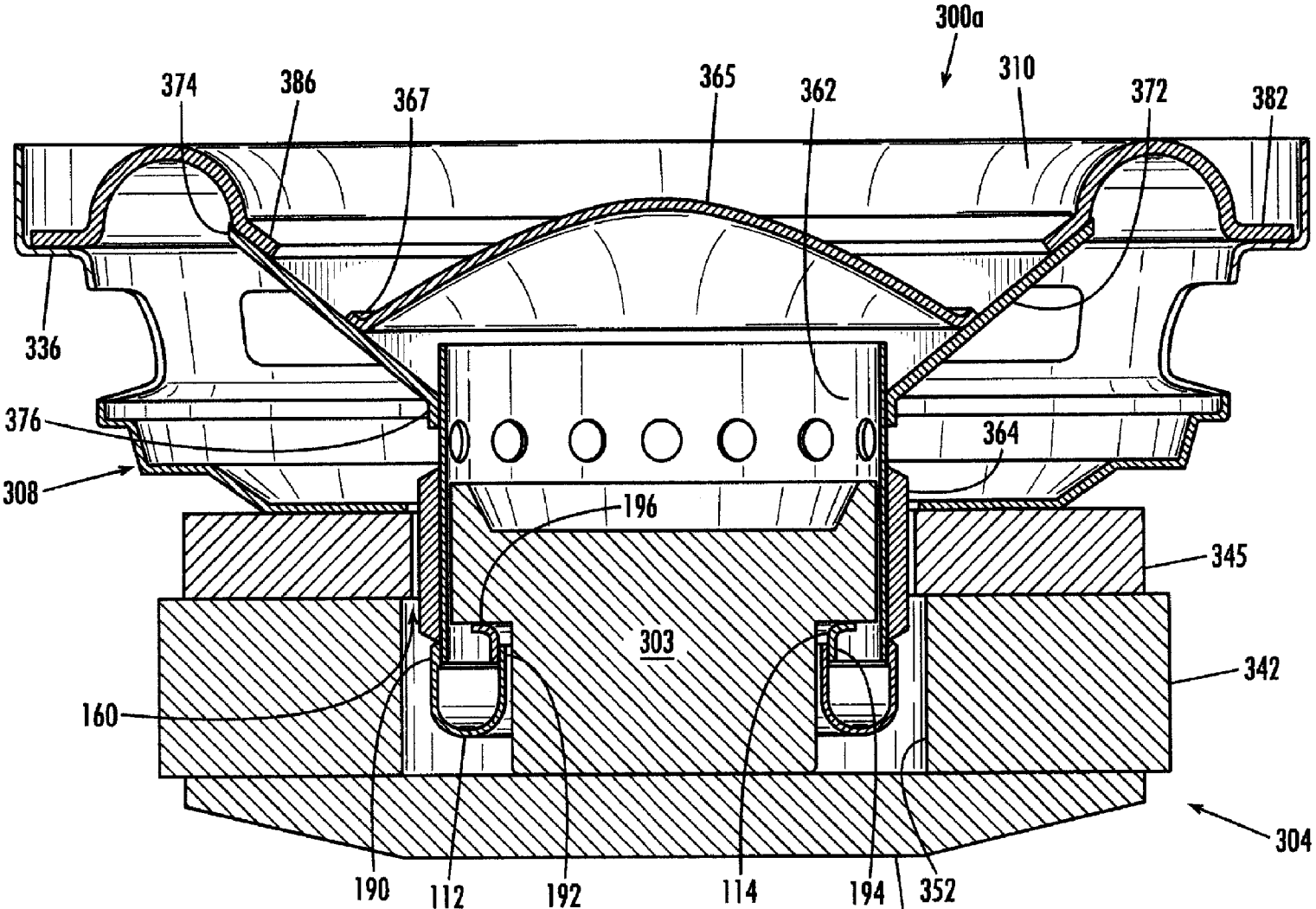
FIG. 12 is a cross-sectional view of an alternate embodiment of a loudspeaker.
Figure 13:
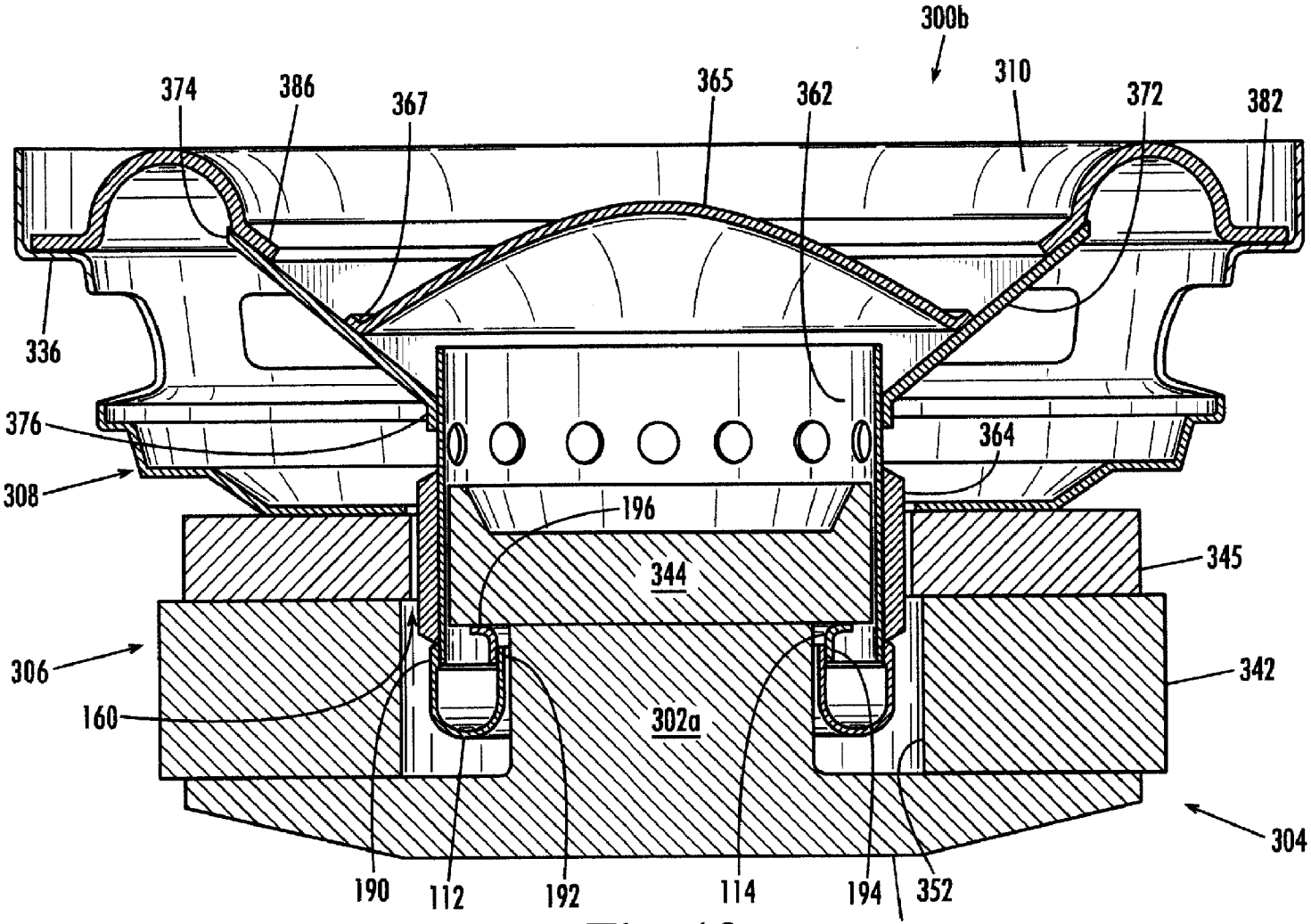
FIG. 13 is a cross-sectional view of an alternate embodiment of a loudspeaker.

Referring now to FIGS. 12 and 13, alternate embodiments of loudspeakers are shown. The alternate embodiments shown in FIGS. 12 and 13 are substantially similar to loudspeaker 300, as shown in FIG. 11. As such, portions of the loudspeakers that are consistent between the various embodiments are represented by the same reference numbers in the Figures. Additionally, because like components are described in detail above with regard to loudspeaker 300, those descriptions are not repeated with regard to the alternate embodiments shown in FIGS. 12 and 13. Only those elements of the alternate embodiments that differ substantially from loudspeaker 300 are discussed.

Referring now to FIG. 12, loudspeaker 300*a* includes a magnet assembly 304 with a pole piece 303 rather than a separately formed throttle 302 and coin 344 (of FIG. 11). As shown, pole piece 303 is fixed to the top surface of bottom plate 316 and serves the same function as the previously discussed throttle 302 and coin 344 (of FIG. 11).

Referring now to FIG. 13, loudspeaker 300*b* differs from loudspeaker 300, as shown in FIG. 11, in that throttle 302*a* is unitarily formed with bottom plate 316*a*.

Figure 14:
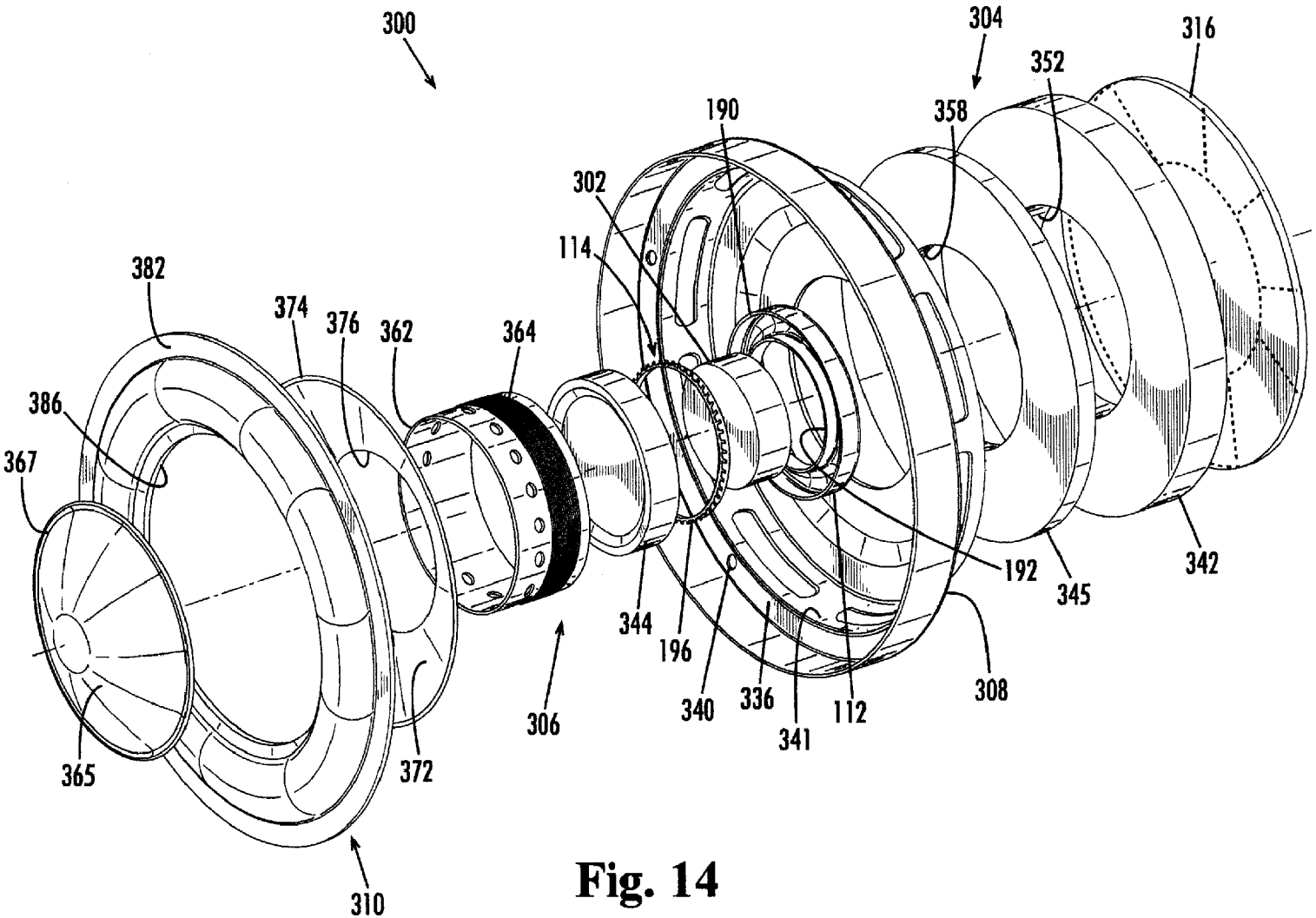
FIG. 14 is an exploded view of the loudspeaker of FIG. 11

Referring now to FIG. 14, an exploded view of a loudspeaker 300 is shown. Reference numbers in FIG. 14 correspond to like numbers in the FIGS. 11-13.

While one or more preferred embodiments are described above, it should be appreciated by those skilled in the art that various modifications and variations can be made without departing from the scope and spirit of the claims. By way of example and not limitation, the shape and number of magnets in the magnet assembly can vary; or the shape of any or all parts of loudspeakers 100 or 300 may depart from nominal cylindrical symmetry. It is intended that the claims cover such modifications and variations as come within the scope and spirit of the appended claims and their equivalents

What is claimed is:

1. A loudspeaker comprising:

a frame;

a moving assembly disposed within the frame, the moving assembly comprising a voice coil assembly, the voice coil assembly comprising a voice coil former having a top edge and a bottom and a voice coil disposed around an outer surface of the voice coil former;

a first suspension element having an outer edge and an inner edge, wherein the outer edge is coupled to the voice coil former adjacent a bottom edge of the voice coil former and the inner edge is coupled to the frame by a magnetic assembly;

a second suspension element having an outer edge and an inner edge, wherein the outer edge is coupled to the frame and the inner edge is coupled to the moving assembly; and a cone having an outer periphery and an inner periphery, wherein the outer periphery is coupled to the frame by the second suspension element and the inner periphery is coupled to the voice coil former.

2. The loudspeaker of claim 1, wherein the voice coil assembly is disposed around the magnet assembly.

3. The loudspeaker of claim 2, the magnet assembly further comprising a magnet secured to the frame and a coin secured to a top portion of the magnet.

4. The loudspeaker of claim 3, wherein the inner edge of the first suspension element is coupled to the coin of the magnet assembly.

5. The loudspeaker of claim 3, wherein the inner edge of the first suspension element is coupled to the magnet of the magnet assembly.

* * * * *